US005795439A

United States Patent [19]

Euripides et al.

[11] Patent Number: 5,795,439

[45] Date of Patent: Aug. 18, 1998

[54] PROCESS FOR MAKING A NON-WOVEN, WET-LAID, SUPERABSORBENT POLYMER-IMPREGNATED STRUCTURE

[75] Inventors: Joanne M. Euripides, Charlotte; Lessie C. Phillips, Huntersville; Steven F. Nielsen, Charlotte, all of N.C.

[73] Assignee: Celanese Acetate LLC, Charlotte, N.C.

[21] Appl. No.: 792,289

[22] Filed: Jan. 31, 1997

[51] Int. Cl.[6] ..... D21H 23/04

[52] U.S. Cl. ..... 162/100; 162/102; 162/146; 162/157.1; 162/157.2; 162/157.6; 162/164.1; 162/168.1; 162/168.3; 162/175; 162/177; 162/183

[58] Field of Search ..... 162/100, 102, 162/146, 157.1, 157.2, 9, 157.4, 157.6, 168.11, 168.3, 177, 182, 175, 164.1, 183

[56] References Cited

U.S. PATENT DOCUMENTS

| | | | |
|---|---|---|---|
| 3,669,103 | 6/1972 | Harper et al. | 128/156 |
| 4,025,472 | 5/1977 | LePoutre | 128/284 |
| 4,128,692 | 12/1978 | Reid | 162/146 |
| 4,354,901 | 10/1982 | Kopolow | 162/146 |
| 4,552,618 | 11/1985 | Kopolow | 162/157.6 |
| 4,610,678 | 9/1986 | Weisman et al. | 604/368 |
| 4,655,877 | 4/1987 | Horimoto et al. | 162/157.2 |
| 4,986,882 | 1/1991 | Mackey et al. | 162/146 |
| 5,049,235 | 9/1991 | Barcus et al. | 162/9 |
| 5,137,600 | 8/1992 | Barnes et al. | 162/115 |
| 5,160,789 | 11/1992 | Barcus et al. | 428/361 |
| 5,214,117 | 5/1993 | Ahmed et al. | 527/309 |
| 5,443,899 | 8/1995 | Barcus et al. | 428/288 |
| 5,531,728 | 7/1996 | Lash | 604/328 |
| 5,547,745 | 8/1996 | Hansen et al. | 428/283 |
| 5,549,791 | 8/1996 | Herron et al. | 162/157.2 |
| 5,607,550 | 3/1997 | Akers | 162/157.4 |

*Primary Examiner*—Peter Chin
*Attorney, Agent, or Firm*—Walter M. Douglas

[57] ABSTRACT

The instant invention is directed to a process for making a non-woven, wet-laid, superabsorbent polymer-impregnated structure. The process generally comprises the steps of: mixing; deliquifying; and drying. Specifically, fibers, superabsorbent polymers, and a liquid are mixed to form a furnish. The liquid is treated with a means for inhibiting the swelling of the superabsorbent polymer. Then, the furnish is deliquified to form a preformed structure. The preformed structure is dried to form the non-woven, wet-laid, superabsorbent polymer-impregnated structure.

15 Claims, No Drawings

PROCESS FOR MAKING A NON-WOVEN, WET-LAID, SUPERABSORBENT POLYMER-IMPREGNATED STRUCTURE

FIELD OF THE INVENTION

The instant invention is directed to a process for making a non-woven, wet-laid, superabsorbent polymer-impregnated structure.

BACKGROUND OF THE INVENTION

Non-woven, wet-laid, superabsorbent polymer-impregnated structures are known. See U.S. Pat. No. 5,167,764 and European Publication No. 437,816. Additionally, the following references disclose previously attempted methods of handling superabsorbent or hydrogel polymers to obtain superabsorbent structures. See U.S. Pat. No. 3,669,103; 4,610,678; 4,986,882; 5,049,235; 5,137,600; 5,160,789; 5,443,899; 5,531,728; and 5,547,745.

Superabsorbent structures are used in the manufacture of sanitary products; for example, disposable diapers and incontinent pads. Such structures could greatly reduce the manufacturing cost of such sanitary products. Accordingly, there is an ongoing need to develop new superabsorbent polymer-impregnated structures.

SUMMARY OF THE INVENTION

The instant invention is directed to a process for making a non-woven, wet-laid, superabsorbent polymer-impregnated structure. The process generally comprises the steps of: mixing; deliquifying; and drying. Specifically, fibers, superabsorbent polymers, and a liquid are mixed to form a furnish. The liquid is treated with a means for inhibiting the swelling of the superabsorbent polymer. Then, the furnish is deliquified to form a preformed structure. The preformed structure is dried to form the non-woven, wet-laid, superabsorbent polymer-impregnated structure.

DETAILED DESCRIPTION OF THE INVENTION

A non-woven, wet-laid, superabsorbent polymer-impregnated structure, as used herein, refers to a fibrous web or felt-like structure, capable of absorbing an aqueous solution, via, predominantly, a wicking or capillary action, and containing, in a predominantly immobile state, superabsorbent polymer, preferably in a particulate form.

Fibers, as used herein, refer to any natural or synthetic fiber in either filament or staple form. The fiber is used to form the web structure. Any natural fiber or synthetic fiber or blends of both may be used. Exemplary fibers include, polyester, polyethylene, polypropylene, polyvinyl alcohol, acrylic, acrylonitrile, nylon, polyurethane, rayon, tetrafluoroethylene, styrene-butadiene rubber, rubber, triacetates, polyamides, polyvinylidene chlorides, polyvinyl chloride, polybenzimidazole, cellulose acetate, cellulose, wood pulp fiber, and the like. The fibers may be filament or staple. Preferably, staple is used. The staple may be any length, but the greater the length, the greater the strength of the preform structure and therefore better handling from deliquification through drying. Staple is usually available in lengths of 0.1 to 2.0 inches. The most preferred lengths are from 0.25 to 0.5 inch. The denier per filament (dpf) is not critical. Preferably, a combination of polyester staple (1.5 dpf×0.5 inch) and cellulose acetate (1.8 dpf×0.25 inch) is used.

Superabsorbent polymer, as used herein, refers to a water insoluble, but water swellable, materials which are capable of absorbing many times their own weight of an aqueous solution. The superabsorbent-polymers generally fall into three classes, namely, starch graft copolymers, crosslinked carboxymethylcellulose derivatives, and modified hydrophilic polyacrylates. Examples of such absorbent polymers are hydrolyzed starch-acrylonitrile graft copolymer, a neutralized starch-acrylic acid graft copolymer, a saponified acrylic acid ester-vinyl acetate copolymer, a hydrolyzed acrylonitrile copolymer or acrylamide copolymer, a modified cross-linked polyvinyl alcohol, a neutralized self-crosslinking polyacrylic acid, a crosslinked polyacrylate salt, carboxylated cellulose, and a neutralized crosslinked isobutylene-maleic anhydride copolymer. The superabsorbent polymer may be surface crosslinked. Preferably, the superabsorbent polymer is in particle form.

Liquid, as used herein, refers to the medium into which the components of the structure are added and mixed. Liquids include, for example; water, methanol, ethanol, other low alkyl alcohols and combinations thereof. Preferably, the liquid is water.

The superabsorbent polymer is designed to absorb liquids, but in the manufacture of wet-laid superabsorbent structures, it is necessary to contact the superabsorbent polymer with a liquid. The contact of the superabsorbent polymer and the liquid can have severe consequences if the superabsorbent polymer swells too much. The swelling of the superabsorbent polymer may be inhibited by either reducing the temperature of the liquid, or by adding a swelling inhibiting compound to the liquid. Inhibiting means to prevent or retard the swelling of the superabsorbent polymer during structure manufacture. One way to inhibit swelling is by maintaining the liquid's temperature below 25° C. Preferably, the liquid's temperature should be between 0° C. and 25° C. Most preferably, the liquid's temperature should be less than 10° C. Alternatively, swelling of the superabsorbent polymer may be inhibited by the addition of a swelling inhibiting compound to the liquid. The swelling inhibiting compound may be salt. Salt means any organic or inorganic salt. The inorganic salts are preferred. The most preferred inorganic salt are NaCl, NaBr, KCl, KBr and combinations thereof. The salt concentration should be greater than 0.9% by weight. Preferably, the concentration may range from 3 to 6% by weight. The most preferred concentration is about 5% by weight. A 5% saline solution can inhibit swelling (as measured by viscosity increase) for up to 30–45 minutes.

The fibers, superabsorbent polymer, and liquid are mixed to form a furnish. Mixing is for a sufficient amount of time and with a sufficient amount of energy, so that all components are wetted out. Conventional dispersants may be used. Any conventional mixing means may be used.

The weight ratio of fiber to superabsorbent polymer may be from 15:85 to 99:1. Preferably, the ratio is from 40:60 to 80:20. Most preferred is a 50:50 ratio. The ratio of dry components (i.e., fiber and superabsorbent polymer) to liquid is not critical, but is sufficient so that the furnish is fluid enough to be deliquified.

The furnish is deliquified. Deliquify refers to the removal of liquid to allow the formation of the preform structure. Deliquification may be performed on any conventional wetlaying equipment, (e.g. handsheeting or papermaking machine, e.g. Fourdrinier wire machine). The deliquified furnish forms a preform structure. If a swelling inhibiting compound is used in the liquid, the preform maybe preferrably, but not necessarily, washed to remove free compound.

The preform structure is dried. Drying refers to the removal of substantially all liquid from the preform structure by input of energy to the preform structure. Drying may be achieved by any conventional manner (e.g. steam heating, airdrying, microwave or infrared radiation or the like). The dried preform structure is the non-woven, wet-laid, superabsorbent polymer-impregnated structure.

The non-woven, wet-laid, superabsorbent polymer-impregnated structure may be formed into a roll good for use in products such as diapers, incontinent pads, feminine hygiene products, medical products, and the like.

To better understand the foregoing invention, reference should be made to the following examples.

EXAMPLES

Example 1

1.5 g cellulose acetate fiber (1.8 dpf×0.25 inch), 1.5 g superabsorbent polymer, (SANWET® IM-4500 from Hoechst Celanese Corporation, Portsmouth, Va.) and water (737 g at 10° C.) are mixed in a 1 liter Waring commercial laboratory blender for 15 seconds. This mixture was poured into an 18 liter laboratory scale head box filled with water at 10° C. The head box mixture was hand mixed, and then the water was released. The total time from the beginning (i.e., adding components to blender) until the end (i.e., discharge of water from head box) was less than two minutes.

Example 2

1.5 g cellulose acetate fiber (1.8 dpf×0.25 inch), 1.5 g superabsorbent polymer (SANWET® IM-4500 from Hoechst Celanese Corporation, Portsmouth, Va.) and saline solution (737 g at 25° C.) are mixed in a I liter Waring commercial laboratory blender for 15 seconds. This mixture was poured into an 18 liter laboratory scale head box filled with 5% saline at 25° C. The head box mixture was hand mixed and then the solution was released. The total time from beginning (i.e., adding components to blender) until the end (i.e., discharge of saline from the head box) was less than two minutes. After formation, the preform is washed to remove saline.

Example 3

A 25 inch wide wet-laid roll good was made in a pilot plant scale. Twenty-one (21) pounds of cellulose acetate fiber (1.8dpf×0.25 inch), three (3) pounds of polyester (PET, 1.5 dpf×0.5 inch) and fifty (50) pounds of superabsorbent polymer (SANWET® IM-4500 from Hoechst Celanese Corporation, Portsmount, Va.), and 100 mls of a conventional dispersant were mixed in a 1700 gallon furnish tank, which contained a 5% saline solution at 11 ° C. The residence times of the mixture in the tank ranged from 30 minutes to one hour, but longer times appear possible. The inclined wire machine's belt-speed was set at 15 feet per minute. The dryer temperature averaged 440° F. The basis weight of this roll good averaged 175 g/square meter.

The present invention may be embodying other specific forms without departing from the spirit or essential attributes thereof, and accordingly, reference should be made to the appended claims rather than to the foregoing specification, as indicating scope of invention.

We claim:

1. A process for making a non-woven, wet laid, superabsorbant polymer-impregnated structure comprising the steps of:

a) mixing fibers and a superabsorbent polymer in an aqueous medium to form a furnish at suitable temperature conditions for a sufficient period of time such that said temperature conditions inhibits the swelling of said superabsorbent polymer;

b) dewatering said furnish to form a preform structure; and c) drying said preform structure to form the non-woven, wet laid, superabsorbent polymer-impregnated structure.

2. The process as set forth in claim 1, wherein said temperature conditions are maintained below 25° C.

3. The process as set forth in claim 1, wherein said temperature conditions are maintained below 10° C.

4. The process as set forth in claim 1, wherein said temperature conditions are in the range of from about 0° C. to about 25° C.

5. The process as set forth in claim 1, wherein said aqueous medium includes a swelling inhibiting compound.

6. The process as set forth in claim 5, wherein said swelling inhibiting compound is a salt.

7. The process as set forth in claim 6, wherein said salt is selected from the group consisting of NaCl, NaBr, KCl, KBr, and mixtures thereof.

8. The process as set forth in claim 6, wherein said salt is present at a concentration in the range of from about 1% to about 6% by weight.

9. The process as set forth in claim 6, wherein said salt is present at a concentration in the range of from about 3% to about 6% by weight.

10. The process as set forth in claim 6, wherein said temperature conditions are maintained below 25° C.

11. The process as set forth in claim 6, wherein said temperature conditions are maintained below 10° C.

12. The process as set forth in claim 6, wherein said temperature conditions are in the range of from about 0° C. to about 25° C.

13. The process as set forth in claim 1, wherein weight ratio of said fibers and said superabsorbent polymer is in the range of from about 15:85 to about 99: 1.

14. The process as set forth in claim 1, wherein weight ratio of said fibers and said superabsorbent polymer is in the range of from about 20:80 to about 80:20.

15. The process as set forth in claim 1, wherein weight ratio of said fibers and said superabsorbent polymer is about 30:70.

* * * * *